United States Patent [19]

Scholten et al.

[11] 3,990,273

[45] Nov. 9, 1976

[54] APPARATUS FOR CLEANING TEXTILES, LEATHER AND FURS BY MEANS OF ORGANIC SOLVENTS, AND FOR WORKING UP THE SOLVENT

[75] Inventors: Wolfgang Scholten, Hofheim, Taunus; Joachim Naumann, Kelkheim, Taunus, both of Germany

[73] Assignee: Hoechst Aktiengesellschaft, Frankfurt am Main, Germany

[22] Filed: May 30, 1975

[21] Appl. No.: 582,358

[30] Foreign Application Priority Data

June 1, 1974 Germany ..... 2426741

[52] U.S. Cl. ..... 68/18 R; 68/18 C; 68/18 F; 69/30

[51] Int. Cl.[2] ..... D06F 43/08

[58] Field of Search ..... 68/18 R, 18 C, 18 F, 68/207; 69/30

[56] References Cited

UNITED STATES PATENTS

| | | | |
|---|---|---|---|
| 3,110,544 | 11/1963 | Moulthrop | 68/18 R |
| 3,236,073 | 2/1966 | Davison et al. | 68/18 C X |
| 3,323,335 | 6/1967 | Schneider | 68/18 R |
| 3,391,550 | 7/1968 | Williams | 68/18 C X |
| 3,543,540 | 12/1970 | Guntner | 68/18 C |
| 3,617,208 | 11/1971 | Burger | 68/18 R X |

*Primary Examiner*—Philip R. Coe
*Attorney, Agent, or Firm*—Curtis, Morris & Safford

[57] ABSTRACT

Apparatus for cleaning textiles, leather and furs by means of organic solvents as well as for working up the solvent, which comprises a cleaning drum with casing connected to a solvent cycle and a feed-back of solvent vapor including vapor liquefaction. The solvent cycle of the apparatus is provided with a pump, a filter, the cited distillation vessel and a solvent supply vessel containing a cooling cycle. The solvent vapor feed-back of the apparatus is provided with a sieve, a compressor, a condenser, a feed-back to the cited distillation vessel (drum casing) between compressor and condenser, and a duct from the condenser to the solvent supply vessel via a gas expansion device. The vapor feed-back is provided with a heat exchanger being part of the cooling cycle on the secondary side and a subsequent stop valve. The cooling cycle is provided with a compressor with subsequent heat exchanger being part of the feed-back on the primary side and a condensing coil being part of the solvent supply vessel.

6 Claims, 1 Drawing Figure

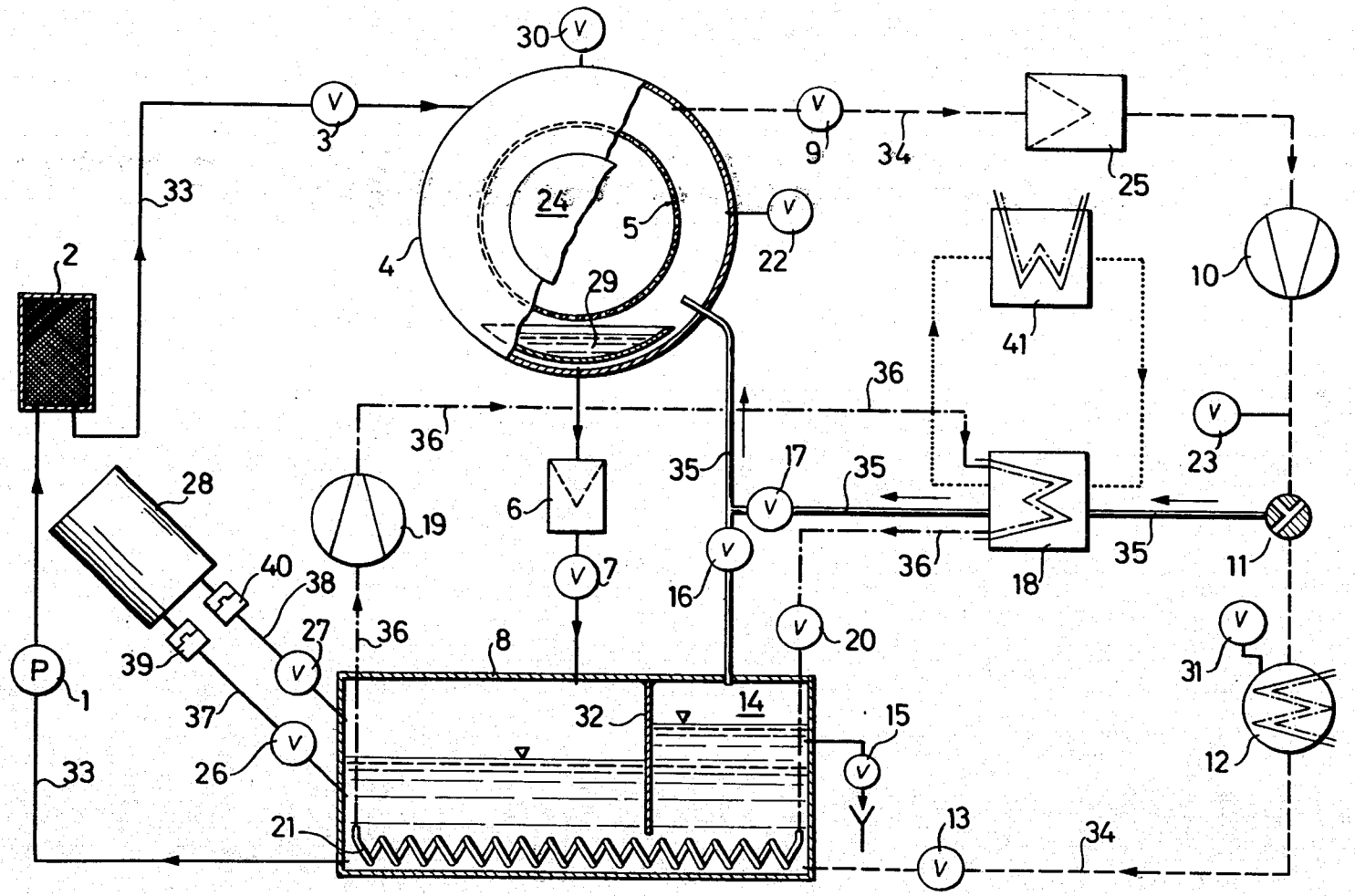
1
2
3
4
5
6
7
8
9
10
11
12
13
14
15
16
17
18
19
20
21
22
23
24
25
26
27
28
29
30
31
32
33
34
35
36
37
38
39
40
41
P
V

APPARATUS FOR CLEANING TEXTILES, LEATHER AND FURS BY MEANS OF ORGANIC SOLVENTS, AND FOR WORKING UP THE SOLVENT

The present invention provides an apparatus which is suitable for cleaning textiles, leather and furs by means of organic solvents, as well as for distilling the solvent polluted in the cleaning operation.

Equipment for cleaning textiles, etc., is well known. It comprises a cleaning drum and casing, which casing is connected to a solvent cycle and a feed-back for the solvent vapor. The solvent supply vessel is part of a cooling cycle maintaining the solvent at a temperature below its boiling point on the one hand, and on the other it is part of a distillation device for the recovery of the solvent polluted in the cleaning operation. The solvent vapor feed-back comprises a compressor and a condenser for the liquefaction of the vapor on the one hand, and on the other a duct via which the vapors heated by compression are fed back to the drum in order to heat the cleaned goods. Such equipment requires much expenditure with respect to apparatus and energy cost.

It is an object of the present invention to provide a compact construction of a simple drum washing apparatus where soiled goods may be cleaned by means of an organic solvent, for example the highly volatile trifluorochloromethane, without consuming too much solvent, and where the solvent may be regenerated in an economic manner. A further object of the invention is to provide the apparatus with a minimum of vessels and an automatic control of all necessary functions (cleaning, centrifugation, drying of the cleaned goods; supply, filtration and distillation of the solvent) in a manner extremely simplified as compared to known equipment, so that any non expert will be able to operate the apparatus without difficulty. These and other objects and advantages will be apparent from the following detailed disclosure.

In accordance with this invention, there is provided an apparatus for cleaning textiles, leather and furs by means of organic solvents as well as for working up the solvent, which comprises a cleaning drum with casing connected to a solvent cycle and a feed-back of solvent vapor including liquefaction; the solvent cycle containing a pump, a fine filter, a sieve, a solvent supply vessel with cooling cycle, and the solvent vapor feed-back containing a sieve, a compressor, a condenser with duct to the solvent supply vessel and feed-back duct to the casing of the cleaning drum between condenser and compressor, wherein the casing of the cleaning drum is constructed as distillation vessel, an expansion device is fitted in the solvent vapor feed-back between the condenser and the solvent supply vessel, a stop valve is fitted in the feed-back duct and a heat exchanger in the cooling cycle, which heat exchanger is part of the solvent vapor feed-back to the drum casing and which heat exchanger is connected with a further heat exchanger in a by-pass.

For the operational handling of the apparatus it is advantageous to provide the drum casing with a bottom box in order to remove without difficulty the impurities precipitated when the distillation is complete. In order to refill the solvent without risk it is advantageous to provide the supply vessel with a refill device. The refill device may, for example, consist of two ducts provided with nonreturn valves and joint pieces to which correspondingly constructed refill vessels are coupled. Advantageously, the ducts are immersed into the solvent in the solvent supply vessel, one of them in the liquid and the other in the gaseous phase.

The present invention will be better understood by reference to the drawing which is a schematic view of an example of the apparatus of the invention.

Referring now to this drawing, the continuously drawn duct 33 is that of the solvent, the dotted duct 34 that of the solvent vapor or the liquefied vapor; the doubly drawn duct 35 that of the solvent vapor feed-back to the drum casing 4, and the dash-dotted duct 36 that of the cooling cycle for the liquid solvent.

The cleaning liquor in the supply vessel 8 is fed to the drum casing 4 by means of a pump 1 via an interchangeable filter 2 and a stop valve 3. In the drum casing, there is a perforated drum 5 turned by a driving motor (not shown) in reverse gear, where the goods to be cleaned are rotated. The cleaning liquor flows back from the drum casing into the supply vessel 8 after having passed through a sieve 6 and a stop valve 7. From the supply vessel, the cleaning liquor is pumped back again into the drum casing 4 via the filter 2. The cleaning liquor cycle may be determined in such a manner that a very small amount of solvent is sufficient for cleaning the goods.

After complete cleaning, the cleaning liquor is discharged into the supply vessel 8 via the sieve 6 and the stop valve 7, and the revolutions of drum 5 are increased in order to remove the solvent from the cleaned goods. After centrifugation, the valve 7 is closed.

The solvent vapors formed during the cleaning operation are aspirated by the compressor 10 from the drum casing 4 via the opened stop valve 9 and the fluff sieve 25, and from there pressed into the air-cooled condenser 12, where they are liquefied again. The condensed solvent flows via the expansion valve 13 into the water separator 14 of the supply vessel 8, and it is cooled again on its way by decompression and partial evaporation.

In the water separator 14, the water possibly entrained separates from the solvent and forms an upper layer on the liquid solvent phase, which layer is discharged from time to time via the valve 15. The water separator is shaped in the supply vessel 8 by means of a partition 32 which is not completely closed at the bottom of the vessel.

After centrifugation, all solvent residues should be removed, if possible, from the cleaned goods by heating them. The valve 17 is opened and the vapors compressed by means of compressor 10 are forwarded to the drum casing 4 via the heat exchanger 18 and duct 35. After heating, the valve 17 is closed again, and the vapor is passed exclusively through the condenser 12 and liquefied. It may be advantageous to insert a three-way control valve 11 into the vapor duct 34 between compressor 10 and condenser 12 at the junction of duct 35.

The cooling cycle, on the cold side, serves for cooling the cleaning liquor and, on the heating side, for warming the solvent vapors or the solvent to be worked up. The cooling agent, for example a fluorinated hydrocarbon such as dichlorodifluoromethane or chlorodifluoromethane, is compressed in the compressor 19, thus causing the formation of heat which is transmitted to the solvent vapors passing by in the gas heat exchanger 18 at opened valve 17. Thus, the cooling agent (refrigerant) is cooled and liquefied in heat exchanger 18, expanded and evaporated via valve 20 in condensor coil 21, and forwarded to compressor 19. At closed valve 17, the gas heat exchanger 18 is cooled by a ventilator or a further heat exchanger 41.

Since in a space without air solvent vapors are more easily condensed than in a space filled with air, the drum casing 4 is evacuated to a pressure as reduced as possible by means of compressor 10 at the beginning of the cleaning operation (that is, before pumping the cleaning liquor into the drum casing 4). About the same reduced pressure is again attained at the end of the drying period. For this reason, an automatic pressostatic control for the drying period is advantageous which prevents the charging door 24 to be opened before the solvent recovery is complete and thus solvent vapors to escape into the surrounding space.

For the evacuation, the valves 9 and 23 are opened, so that compressor 10 aspirates a large amount of air from the drum casing 4. When the reduced pressure is about attained again at the end of the drying period, valve 22 is opened in order to obtain a pressure balance. Thus, the air is allowed to flow back to the drum casing 4, and the charging door 24 may be opened.

The supply vessel 8 is refilled with solvent via duct 37, and the pressure balance between refill cartridge 28 and supply vessel 8 is maintained via duct 38. Both ducts are provided with through-way nonreturn valves 26 and 27 which can be shut off. The solvent refill cartridge 28 is advantageously provided on its front side with two throughway nonreturn valves (not shown) which open themselves upon counterpressure. The refill cartridge can be coupled to the ducts 37 and 38 by means of quick-action couplings 39 and 40.

After about 10 cleaning operations, the cleaning liquor must be worked up. For this purpose, the liquor, after evacuation of the drum casing 4, is forwarded from the supply vessel 8 by means of pump 1 via the filter 2 and the valve 3 to the drum casing. Since generally a highly volatile solvent is used, the evaporation of the solvent requires relatively small energy expenditure.

First, the solvent vapors are compressed and warmed by the compressor 10, then heated again in the gas heat exchanger 18 and feed-back to the drum casing 4 via duct 35. When the boiling point which is further decreased by the reduced pressure is attained, the valve 17 is closed and the vapors passed on to condenser 12 were they are liquefied. From there, the liquefied vapors are forwarded via the expansion valve 13 to the supply vessel 8. If necessary, heating and condensation of the solvent vapors may be repeated once or several times. After complete distillation, the recovery cycle is closed and the drum casing 4 ventilated by opening the through-way valve 22.

In the bottom box 29, the residue from working up the solvent is collected. The drum casing 4 is provided with an emptying door (not shown) at the level of the bottom box 29 through which door this box may be taken off for emptying.

The valves 30 on the drum casing 4 and 31 on the condenser 12 are spring-loaded safety valves which open themselves upon exceeding a determined overpressure stipulated for the two pressure vessels. The valve 16 ensures the pressure balance between drum casing 4 and supply vessel 8 at closed valve 7 and the condenser 12 shut off.

Suitable solvents are organic solvents, for example chlorinated or fluorinated hydrocarbons, especially trichlorofluoromethane, tetrachlorodifluoroethane, trichlorodifluoroethane or trichlorotrifluoroethane or mixtures of two of these solvents each.

What is claimed is:

1. An apparatus for cleaning textiles, leather and furs using a volatile organic cleaning solvent which comprises:

a cleaning drum rotatably mounted within a casing, said casing surrounding and enclosing said drum, means for circulating liquid solvent including a solvent supply vessel, a connecting means connecting said solvent supply vessel to said drum casing, said connecting means including a filter, a pump for withdrawing solvent from said supply vessel and pumping it through said filter and to said drum casing, a sieve, and return connecting means connecting said casing through said sieve to said supply vessel, cooling means including an evaporator coil disposed within said solvent supply vessel, an indirect heat exchanger, connecting means connecting said evaporator coil to said indirect heat exchanger, a compressor within said last mentioned connecting means for withdrawing refrigerant from said evaporator coil to compress and feed said refrigerant to said heat exchanger, an expansion means, and return connecting means connecting said heat exchanger through said expansion means to said evaporator coil disposed within said supply vessel, means for recirculating solvent vapor including a solvent vapor compressor for withdrawing and feeding solvent vapor from said drum casing, connecting means including a sieve connecting the drum casing to said solvent vapor compressor, further connecting means connecting said solvent vapor compressor to said heat exchanger in which heat exchanger the compressed solvent vapor is heated by indirect heat exchange with said heated compressed refrigerant vapor from said cooling means, and return connecting means connecting said heat exchanger to said drum casing for returning said heated compressed solvent vapor to said drum casing to heat said drum, a condenser, additional means connecting said solvent vapor compressor to said condenser in which condenser the compressed solvent vapor is cooled and liquefied, a further expansion means, means connecting said condenser to said further expansion means and through said further expansion means to said solvent supply vessel wherein the expanded solvent vapor cools the solvent in said supply vessel.

2. The apparatus of claim 1 wherein the means for recirculating solvent vapor further includes a stop valve disposed between the compressor, heat exchanger, and condenser.

3. The apparatus of claim 1 wherein the cooling means heat exchanger is connected in heat exchange relationship with a second heat exchanger.

4. The apparatus of claim 1 wherein the drum casing has operably connected thereto means to collect and remove solvent residue material from said drum casing.

5. The apparatus of claim 1 wherein the solvent supply vessel has connected thereto a means for filling said vessel with solvent consisting of a first connecting means immersed in the solvent liquid phase in said supply vessel and a second connecting means disposed in the solvent gas phase in said supply vessel.

6. The apparatus of claim 1 wherein said solvent supply vessel contains a vertical partition depending downwardly from a top wall of said vessel and not completely closed at the bottom of said vessel, said partition separating the supply vessel into a water-free solvent side and a water containing water-solvent separator side.

* * * * *